United States Patent [19]

Studer

[11] 3,951,759

[45] Apr. 20, 1976

[54] CHROMIUM ELECTROPLATING BATHS AND METHOD OF ELECTRODEPOSITING CHROMIUM

[75] Inventor: Walter Studer, Olten, Switzerland

[73] Assignee: Rotel-Holding AG, Basel, Switzerland

[22] Filed: Jan. 20, 1975

[21] Appl. No.: 542,385

[30] Foreign Application Priority Data

Jan. 23, 1974 Switzerland ..... 792/74
June 12, 1974 Switzerland ..... 8130/74

[52] U.S. Cl. ..... 204/32 R; 204/51
[51] Int. Cl.[2] ..... C25D 3/10; C25D 5/34
[58] Field of Search ..... 204/51, 43 R, 32 R

[56] References Cited

UNITED STATES PATENTS

| | | | |
|---|---|---|---|
| 3,108,933 | 10/1963 | Johnson | 204/51 |
| 3,282,812 | 11/1966 | Brown et al. | 204/51 |
| 3,505,183 | 4/1970 | Seyb et al. | 204/51 |

*Primary Examiner*—G. L. Kaplan
*Attorney, Agent, or Firm*—Woodhams, Blanchard and Flynn

[57] ABSTRACT

An aqueous acidic chromium electroplating bath comprising 200 to 550 g/l of chromium trioxide, 1 to 18 g/l of strontium sulfate, 2 to 30 g/l of potassium silicofluoride, 2 to 8 g/l of potassium dichromate and 4 to 50 g/l of 2,2-dichloromalonic acid or salt thereof.

10 Claims, No Drawings

CHROMIUM ELECTROPLATING BATHS AND METHOD OF ELECTRODEPOSITING CHROMIUM

This invention relates to baths for chromium electroplating and a method of electrodeposition of chromium. More particularly this invention relates to baths which contain an aqueous chromium (VI) solution comprising 200 to 550 g/l chromium trioxide, 1 to 18 g/l strontium sulfate, 2 to 30 g/l potassium silicofluoride and 2 to 8 g/l potassium dichromate, which baths also contain, as a synergetic additive, 4 to 50 g/l technical 2,2-dichloromalonic acid or a salt thereof, for obtaining a chromeplating of perloid structure with a hardness of 1050 to 1500 Vickers units, the electroplating operation taking place within a temperature range of 45° to 60°C and at a current density of 40 to 500 amp/dm$^2$.

The electrodeposition of chromium with optimal physical properties such as hardness, anti-frictional properties, surface structure as well as adherence to the substrate still seems to encounter difficulties which are partially due to the fact that the hexavalent chromium has to be reduced to metallic chromium. Attempts to increase the efficiency of chromium-plating by using chromium baths wherein the chromium is contained in tri-valent form have not given satisfaction because such electrodeposition could not meet practical requirements. In particular, such chromium adheres poorly to the substrate.

It is known to the inventors that previously used chromium-plating baths consisted of aqueous solutions of chromium trioxide and sulfuric acid, wherein the ratio of chromium trioxide to sulfate was within the range of 100: 1. Such baths with hexavalent chromium have been used for electroplating for a long time and they displayed amongst other characteristics relatively low capacity and poor current efficiency. Fluorine ions were used as catalyzer ions acting together with the sulfate ions, and, additionally, there were used other anions which only supported the efficiency of the sulfate ions. These anions were present in low concentrations and were generally designated as catalyzer ions. The understanding prevails that the sulfate ion is the only real catalyzer anion and that the other anions produce only additional effects.

Chromium coatings which at a thickness of less than 0.5 $\mu$ appear porous and at a thickness of more than 0.75 $\mu$ show larger cracks may be deposited from the aforesaid chromium baths. These characteristics explain the relatively poor capacity of deposition and the limited low current density, below which no further chromium can be deposited. Below a current density of 2.15 amp/dm$^2$ no further chromium coatings can be deposited from the traditional chromium baths, whilst above this current density the current efficiency amounts to about 5%.

A proposal to improve chromeplating for the production of coatings through the addition of alkaline compounds is known to the inventors. For hastening the deposition of chromium and increasing the current efficiency it has been proposed to work with baths containing sodium tetrachromate with a molecular ratio of $Na_2O$ to $CrO_3$ between 1 : 4 and 1: 6. It has been found that with the aforesaid ratios only soft chromium coatings of a maximum hardness of 800 Vickers units could be obtained.

Chromeplating baths which contain as additives halogenated aliphatic carboxylic acids are known to the inventors. These acids are polyhalogenated succinic, glutaric or adipic acids, and these additives have been added to the baths in a range of 1 to 10 g/l. During the further development of chromeplating baths it has been observed by the inventors that a bath works more efficiently if, instead of using 1 to 10 g/l, there are used more than 25 g/l of these halogenated organic carboxylic acids. In particular, very good results have been obtained with 3,4-dichloro-adipic acid or 2,2-dichloro-succinic acid.

The disadvantages of such electroplating chromium baths appear to be that the maximum current density is 50 amp/dm$^2$ and the current efficiency is only 14%. The maximum obtainable hardness of such chrome coatings is 1000 Vickers units.

Investigations known to the inventors have revealed that all chlorine compounds, which during electroplating release chlorine, cannot be considered because the corrosive properties of the free chlorine may damage a workpiece. It has in any case been established that the chlorides of the aliphatic carboxylic acids, e.g. malonic acid chloride or its dichloride, are useless. Employment of dichloro-succinic acid produced only poor results.

One can understand that the sulfate and fluorine ions designated as catalyzers are in fact not catalyzers since they disintegrate slowly but steadily during the process of electroplating. Should this not be the case, it would not be necessary to supply self-regulating baths with salts producing depositing effects.

According to the invention there is provided an acidic bath for chromium electroplating comprising an aqueous chromium (VI) solution having 200 to 550 g/l chromium trioxide, 1 to 18 g/l strontium sulfate, 2 to 30 g/l potassium silicofluoride, 2 to 8 g/l potassium dichromate, and as a synergetic additive, 4 to 50 g/l 2,2-dichloro-malonic acid or a salt thereof. Technical 2,2-dichloromalonic acid, or an alkali metal salt, such as the potassium salt, may be used.

Also according to the invention there is provided a method for the electrodeposition of chromium by using a bath as herein described, including the steps of operating the bath within a temperature range of 45°C to 60°C and a current density of 40 to 500 amp/dm$^2$, or more specifically at 53° ± 2°C and 50 to 200 amp/dm$^2$.

The addition of technical 2,2-dichloromalonic acid to a self-regulating chromium bath, together with the interaction of the sulfate and fluorine ions, is capable of influencing the chromium deposit to such an extent that quite different and improved physical properties are revealed. The addition of monochloromalonic acid, instead of 2,2-dichloromalonic acid, has proved, however, to be unsuitable.

The invention makes available new baths for chromium electroplating, which make possible improved dispersion power, better current efficiency and higher current density as well as a greater hardness of the chromium coating. Further characteristics of the invention are that the deposited chromium is substantially crack resistent, that a hardness of up to 1500 Vickers units may be obtained, as well as an extremely good adhesion of the chromium coating upon the workpiece, especially if the latter has been previously freed from and is maintained free of oxide. The deposited chromium coating shows a brilliant to cool light-gray surface, according to the surface quality of the substrate and the current density.

It will be understood that, on the one hand, the ratio of 2,2-dichloromalonic acid to strontium sulfate and, on the other hand the ratio, of 2,2-dichloromalonic acid to potassium silicofluoride have well determined effects on the properties of the coating. The electrolyte may be varied according to the desired results.

It has been ascertained that, with unchanged amounts of 2,2-dichloromalonic acid and sulfate but with an amount potassium silicofluoride between 2 g/l and 20 g/l, an increase up to 20% of dispersion of the coating is obtained with a loss of up to 100 Vickers hardness units.

With unchanged amounts of 2,2-dichloromalonic acid and potassium silicofluoride but with an amount of 1 to 10 g/l of sulfate one gains an increase in hardness of the coating up to 1500 Vickers units, with simultaneous reduction of the elasticity of the coating.

On the other hand, if the amount of 2,2-dichloromalonic acid is increased by 4 to 35 g/l, the conductivity of the bath will be improved with an increase in the current efficiency. When increasing the amount of 2,2-dichloromalonic acid to more than 50 g/l one obtains hard-brittle chromium coatings. A possible shortage of potassium may be replenished by inorganic and/or organic potassium salts, e.g. potassium chromate.

An electrolyte composition according to the invention, as cited in the Example 1, produces more ductile chromium coatings which are well suited for lengthening the life of cutting tools. At a favourable bath temperature of 51° to 55°C the hardness of the coating may be adjusted from 1050 to 1250 Vickers units permitting 50 to 200 amp/dm$^2$ current density. The formation of cracks is thereby correspondingly low (of the order of 10 cracks/cm).

The relationship of the current efficiency to current density in a bath composition according to the Example is shown in table 1.

The chromium plating bath according to the invention allows a timely increase of the chromium coating thickness, as follows:

0.5 $\mu$/minute at a current density of 50 amp/dm$^2$,
1.2 $\mu$/minute at a current density of 130 amp/dm$^2$, and
1.5 $\mu$/minute at a current density of 200 amp/dm$^2$.

The increase in coating thickness does not show a linear relationship with an increase in current density.

The quality of the chromium coating can also be influenced, as known from other chromium baths, through variation of the bath temperature. With increased bath temperature the dispersion capacity and hardness decline. With lowered bath temperature the dispersion capacity as well as the hardness will be slightly improved. Chromium coatings which have been deposited at an electrolyte temperature of less than 45°C are hardly ever applied technically. The temperature in the Example is 50° ± 2°C.

The pearloid structure of the chromium coatings according to the invention which depends exclusively on the surface quality of the substrate and the current density, shows very favourable anti-friction properties. The following comparisons will illustrate the coefficients of friction of various metals with a chromium coating according to the Example of the present invention:

| Materials | Coefficient of friction Static | Dynamic |
|---|---|---|
| steel against steel | 0.21 | 0.15 |
| steel against chrome | 0.18 | 0.13 |

-continued

| Materials | Coefficient of friction Static | Dynamic |
|---|---|---|
| Chrome against chrome | 0.14 | 0.11 |

Chromium coatings according to the invention possess very good adhesion to the substrate because the bond is more molecular than mechanical. The rapid consumption of the relatively high electric energy needed, takes place directly at the surface of the metal substrate, e.g. steel, an iron-chromium carbide with a relatively thin chromium coating forming on this surface. With the appropriate means for structure investigation of metallography the behaviour of these chromium coatings may be observed. The good adhesive capacity of the chromium coatings can be proved experimentally as follows:

A bending rod of 2 mm $\phi$ covered with a chromium coating according to the invention of 5 – 10 $\mu$, when bent over a radius of 10 mm, shows cracks only after a bending of 18°. With a bending of 180° the cracks extend to the substrate. However, no chromium particles will break away as is normally the case with chromium coatings known to the inventors.

For good adhesion of chromium coatings to the substrate, pretreatment of the latter is necessary. It is important to remove the very thin oxide film which adheres to every metal, and to prevent the forming of a new film. The best results are obtained by using aqueous jets, containing glassmeal, wherein an inhibitor e.g. 0.5% $NaNO_2$ (sodium nitrite) is added to the water.

Hydrogen embrittlement of the workpiece is less prevalent in the electrolyte than in previously known baths. The duration of exposure of the workpiece to be treated is, by reason of the rapid deposition of the coating which can be up to 1.5 $\mu$/min. and the relatively thin chromium coating of 5 – 10 $\mu$, very short in the dissociated hydrogen. The cited iron-chromium carbide formation as well as the deposition of chromium and the Joulean heating are highly energy absorbing so that relatively less energy remains available for the dissociation of hydrogen. The hydrogen, which is formed from the electrolyte, re-combines partially with the dissociated oxygen to form water, on the surface of the workpiece (point of energy transformation), the rest volatilizing. To discharge the remaining hydrogen, which penetrates into the workpiece, it is known to the inventors to apply heat treatment after a chrome-plating process, whereby through the effects of heat at 200°C during 4 hours, approximately 80% of the hydrogen can be expelled. This post-treatment is recommended with workpieces which are highly carbonaceous and especially thin-walled, e.g. knife edges, springs, and the like. It is thereby presupposed that steels with a low carbon ratio and those with more than 1.5% silicon content or those which have been tempered at higher ranges of temperature are less sensitive to diffusion of hydrogen.

Another factor reducing hydrogen embrittlement is the vigorous circulation of the electrolyte which must take place during the plating process. The dissociated hydrogen is thereby rapidly removed from the workpiece. Furthermore, the vigorous agitation of the electrolyte, circulated about 8 times the bath content per hour, causes maximum solubility of the chemical components contained in the bath. In the bath itself there is no formation of bottom sediment as it occurs with SRHS baths known to the inventors. The quality of the electrolyte therefore remains at an optimum for lengthened periods of use. The electrolytes are suitable for the deposition of chromium coating on all materials known to be chrome-plateable; they are therefore not dependent on the substrate.

With proper handling of the present chromeplating baths and with due consideration of the aforesaid, chromium coatings can be deposited, by adequate operation and electrolyte composition in the various fields of application, in superior qualities of hard chrome than known until the present time to the inventors.

For a better comprehension of the invention, a non-limiting Example of an electrolyte composition is given below:

Example:

| | | |
|---|---|---|
| Electrolyte consisting of | 382 | g/l chromium trioxide |
| | 3.8 | g/l potassium silicofluoride |
| | 7.2 | g/l strontium sulfate |
| | 32.0 | g/l 2,2-dichloromalonic acid |
| | 6.5 | g/l potassium dichromate |

The current efficiencies according to the invention are stated in the following table:

| Current density amp/dm² | Current efficiency % |
|---|---|
| 30 | 21.8 |
| 50 | 22.9 |
| 80 | 24.5 |
| 100 | 22.9 |
| 130 | 24.6 |
| 160 | 23.5 |
| 200 | 27.2. |

Having now particularly described and ascertained our said invention and in what manner the same is to be performed, we declare that what we claim is:

1. A bath for the electroplating of chromium comprising an aqueous acidic hexavalent chromium solution containing 200 to 550 g/l chromium trioxide, 1 to 18 g/l strontium sulfate, 2 to 30 g/l potassium silicofluoride, 2 to 8 g/l potassium dichromate, and as a synergetic additive 4 to 50 g/l 2,2-dichloromalonic acid or a salt thereof.

2. A bath for the electroplating of chromium according to claim 1, wherein said synergetic additive is potassium 2,2-dichloromalonate.

3. A bath for the electroplating of chromium according to claim 1, wherein said synergetic additive is 2,2-dichloromalonic acid admixed with potassium 2,2-dichloromalonate.

4. A bath for the electroplating of chromium according to claim 1, wherein the amount of potassium silicofluoride is from 2 g/l to 20 g/l.

5. A bath for the electroplating of chromium according to claim 1, wherein the amount of strontium sulfate is from 1 g/l to 10 g/l.

6. A method for the electro-deposition of chromium coating on a metal workpiece, comprising using a bath according to claim 1, and including the step of operating the bath at a temperature range of 45° to 60°C and a current density of 40 to 500 amp/dm².

7. A method according to claim 6, wherein the bath is operated at a current density of 50 to 200 amp/dm² and a working temperature of 53° ± 2°C.

8. A method according to claim 6, including the steps of removing an oxide film from the metal workpiece and preventing the formation of a new oxide film by means of inhibitors until the workpiece is placed in the bath.

9. A method according to claim 6, wherein the plating conditions are effective to form an iron-chromium carbide zone on the surface of the workpiece so that the binding of the chromium coating upon the workpiece is of a molecular type.

10. A method according to claim 6, wherein the rate of circulation of the electrolyte is at least 8 times the volume of the bath per hour.

* * * * *